US009420841B2

(12) United States Patent
Anderson

(10) Patent No.: US 9,420,841 B2
(45) Date of Patent: Aug. 23, 2016

(54) WEARABLE PROTECTION DEVICE AND METHOD THEREOF

(76) Inventor: Lawrence Everett Anderson, Arlington, VA (US)

( * ) Notice: Subject to any disclaimer, the term of this patent is extended or adjusted under 35 U.S.C. 154(b) by 1330 days.

(21) Appl. No.: 12/917,459

(22) Filed: Nov. 1, 2010

(65) Prior Publication Data

US 2012/0102630 A1 May 3, 2012

(51) Int. Cl.
*A42B 3/12* (2006.01)
*A42B 3/06* (2006.01)
*A42B 3/04* (2006.01)

(52) U.S. Cl.
CPC ..... *A42B 3/0486* (2013.01)

(58) Field of Classification Search
CPC ..... A42B 3/0486
USPC ..... 2/413, 455, 410, 415, 414; 180/284, 180/282; 280/730.1, 748, 751, 753
See application file for complete search history.

(56) References Cited

U.S. PATENT DOCUMENTS

| | | | | |
|---|---|---|---|---|
| 3,452,175 | A | 6/1969 | Wilkes | |
| 3,713,640 | A * | 1/1973 | Margan | 267/117 |
| 4,324,005 | A * | 4/1982 | Willis | 2/413 |
| 4,663,785 | A * | 5/1987 | Comparetto | 2/413 |
| 5,129,106 | A * | 7/1992 | Liou | 2/411 |
| 6,039,347 | A | 3/2000 | Maynard | |
| 6,423,019 | B1 * | 7/2002 | Papay et al. | 602/17 |
| 7,150,048 | B2 * | 12/2006 | Buckman | 2/465 |
| 7,328,462 | B1 * | 2/2008 | Straus | 2/411 |
| 2008/0155735 | A1 * | 7/2008 | Ferrara | 2/412 |

OTHER PUBLICATIONS

TRW Occupant Safety Systems, Airbag Inflators, DI-10 Pyrotechnic Driver Inflator, D19.xG Pyrotechnic Driver Inflator, HGI P6.8 Heated Gas Passenger Inflator, PHI4-1s/PHI4-2s Passenger Hybrid Inflator, PPI-3 1s; 2s Pyrotechnic Passenger Inflator, PPI-5 1s; 2s Pyrotechnic Passenger Inflator, ROI Roll Over Inflator, SHI Small Hybrid Inflator, SHI2 Small Hybrid Inflator (Second Generation); SPI-2 Side Pyrotechnic Inflator, TRW Occupant Safety Systems, Worldwide Headquarters, 4505 W. 26 Mile Rd., Washington, MI 48094, USA.

ADXL-50 by Analog Devices, Monolithic Accelerometer With Signal Conditioning, Analog Devices, One Technology Way, PO Box 9106, Norwood, MA 02062-9106, Copyright 1996.

Motorcycle News "Dainese airbag suit in action," Nov. 21, 2007 (abstract only).

"Parts: Digital Proximity Sensor (Sharp® GP2Y0D02)", Web page from URL http://www.makeclub.org/ideas/items/view/3164, Jan. 5, 2009.

* cited by examiner

*Primary Examiner* — Clinton T Ostrup
*Assistant Examiner* — Catherine M Ferreira

(57) ABSTRACT

A method and device adapted to be worn on the head of a user comprising: at least one inflatable band, one of a proximity sensor, inertia switch, or gravity type switch, a gas releasing device which causes the inflatable band to inflate when the proximity sensor or inertia switch is actuated, whereby when the device is worn on the head of the user is automatically activated in the case of a fall or impact to cushion the head of the user.

20 Claims, 23 Drawing Sheets

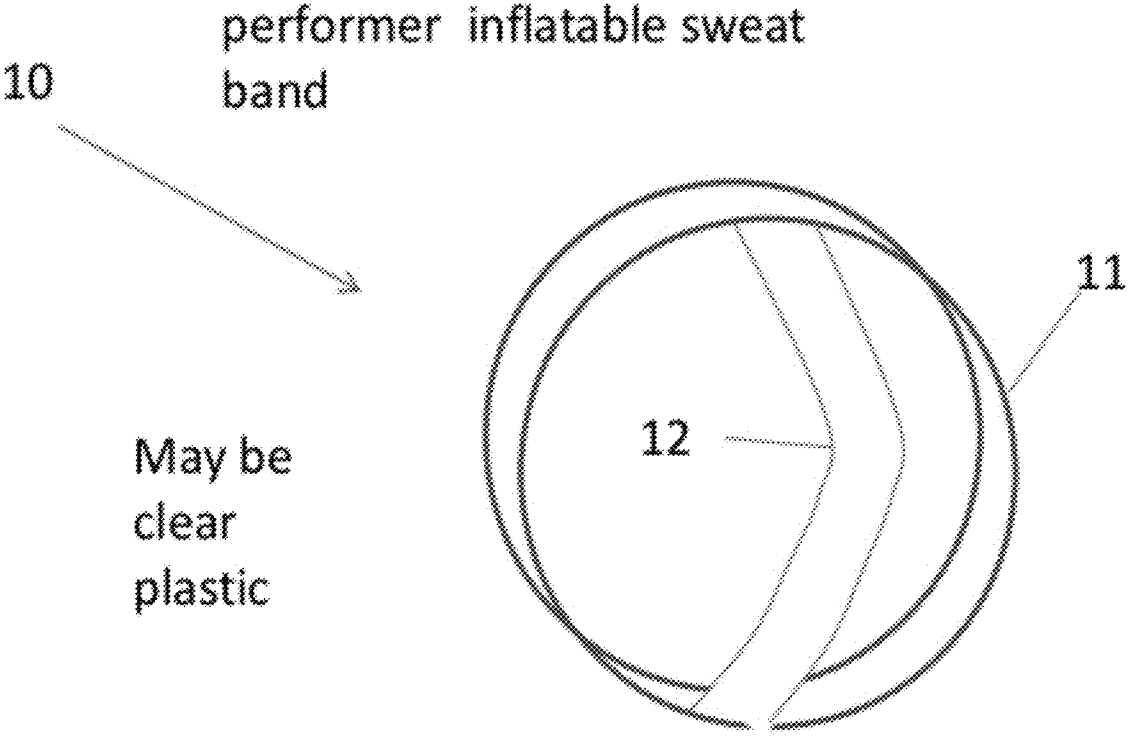
FIG. 1 TOP VIEW

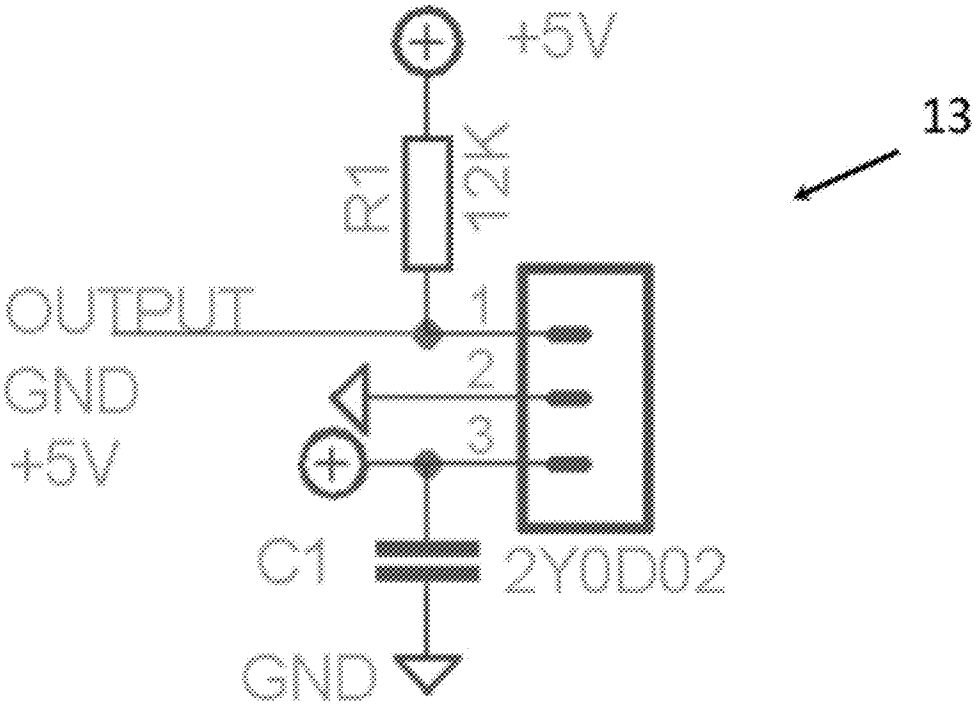
FIG. 2 PRIOR ART PROXIMITY SENSOR

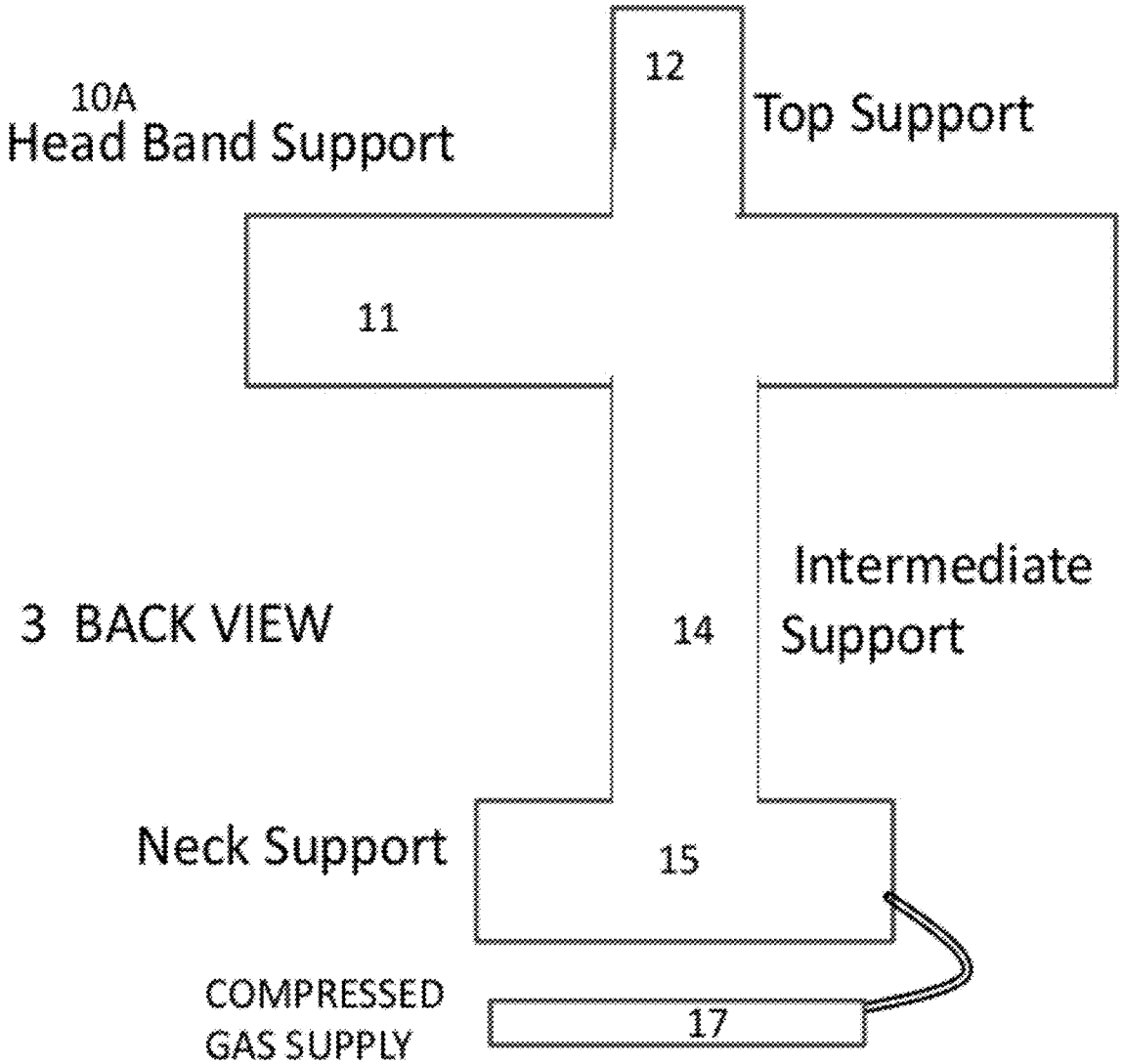
FIG. 3 BACK VIEW

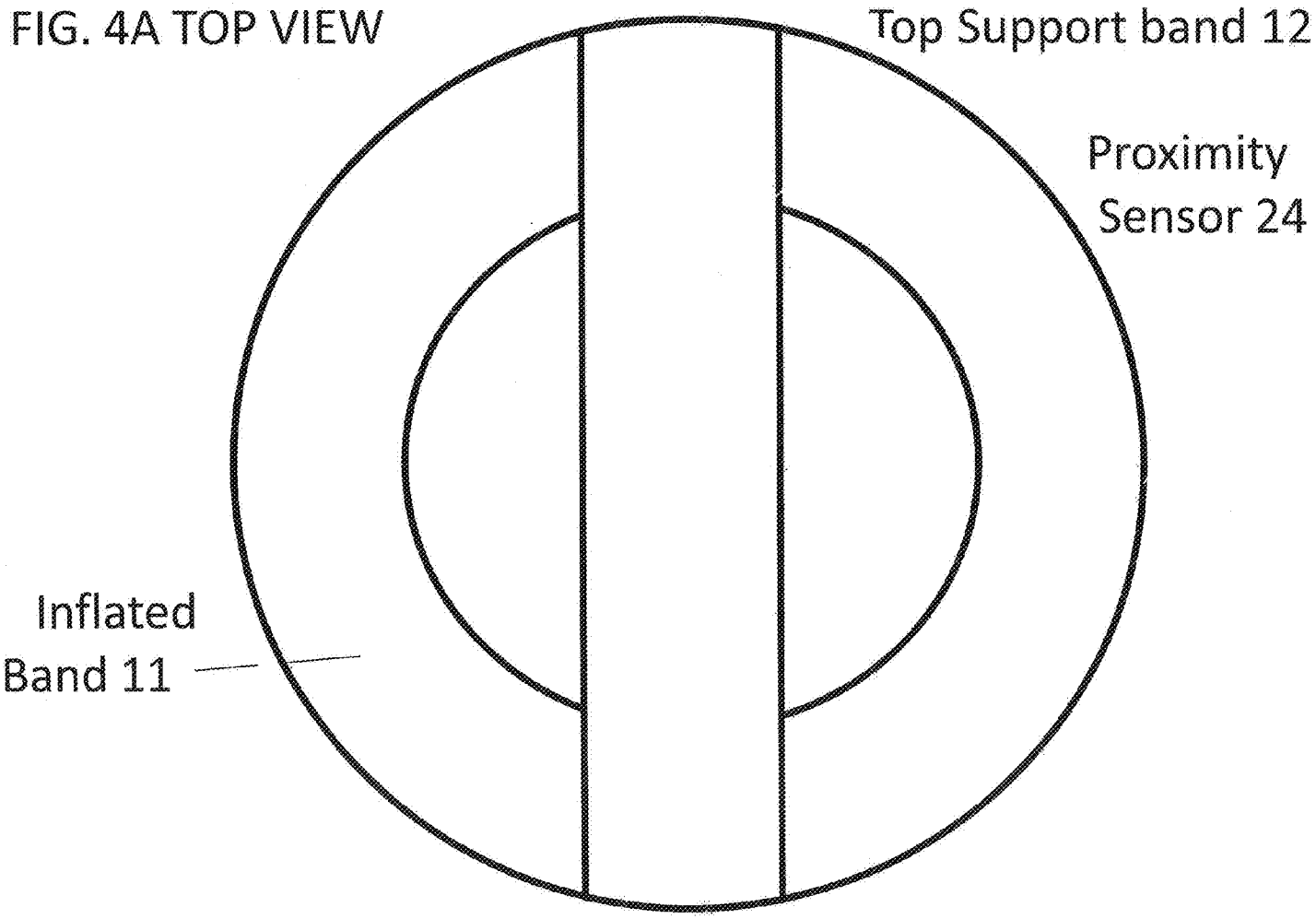
FIG. 4A TOP VIEW

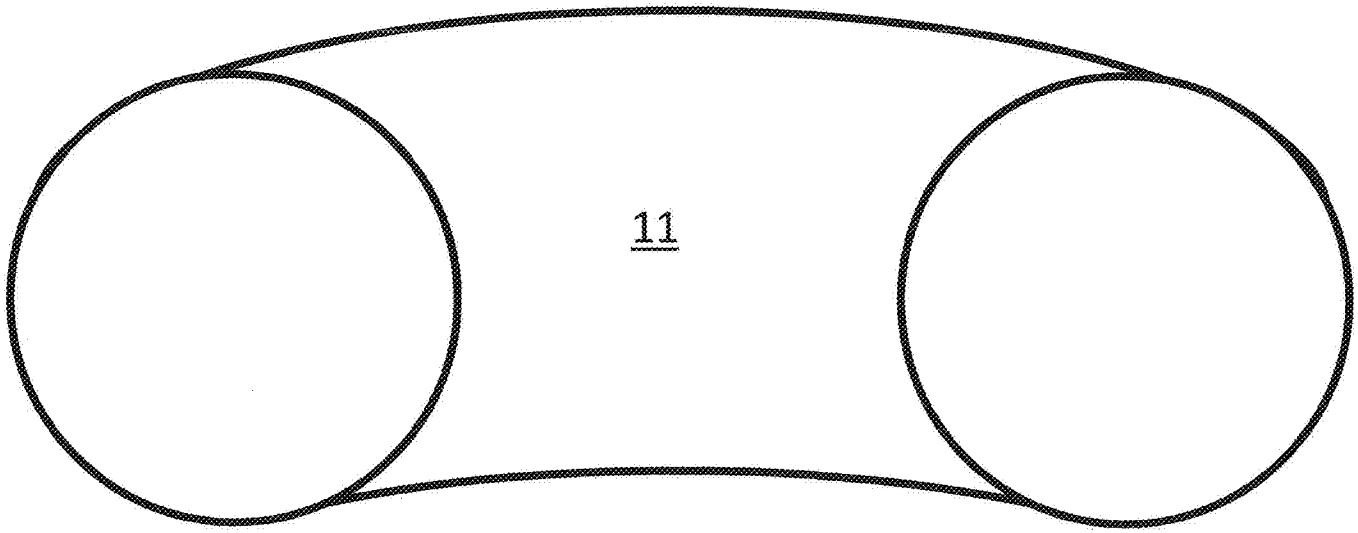
FIG. 4B PARTIAL VIEW
CROSS SECTION

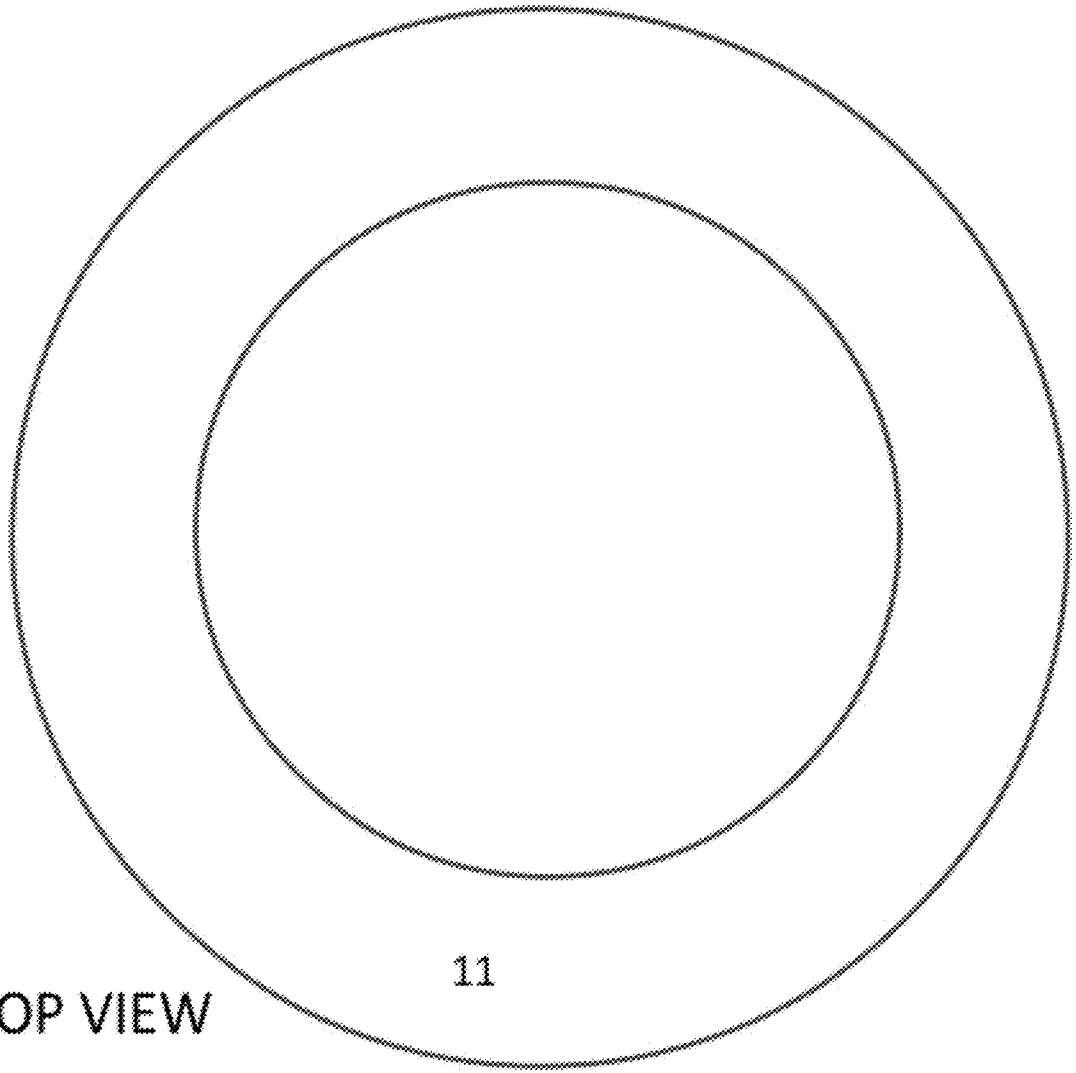
FIG. 6A TOP VIEW

INFLATION OF BAND 11A

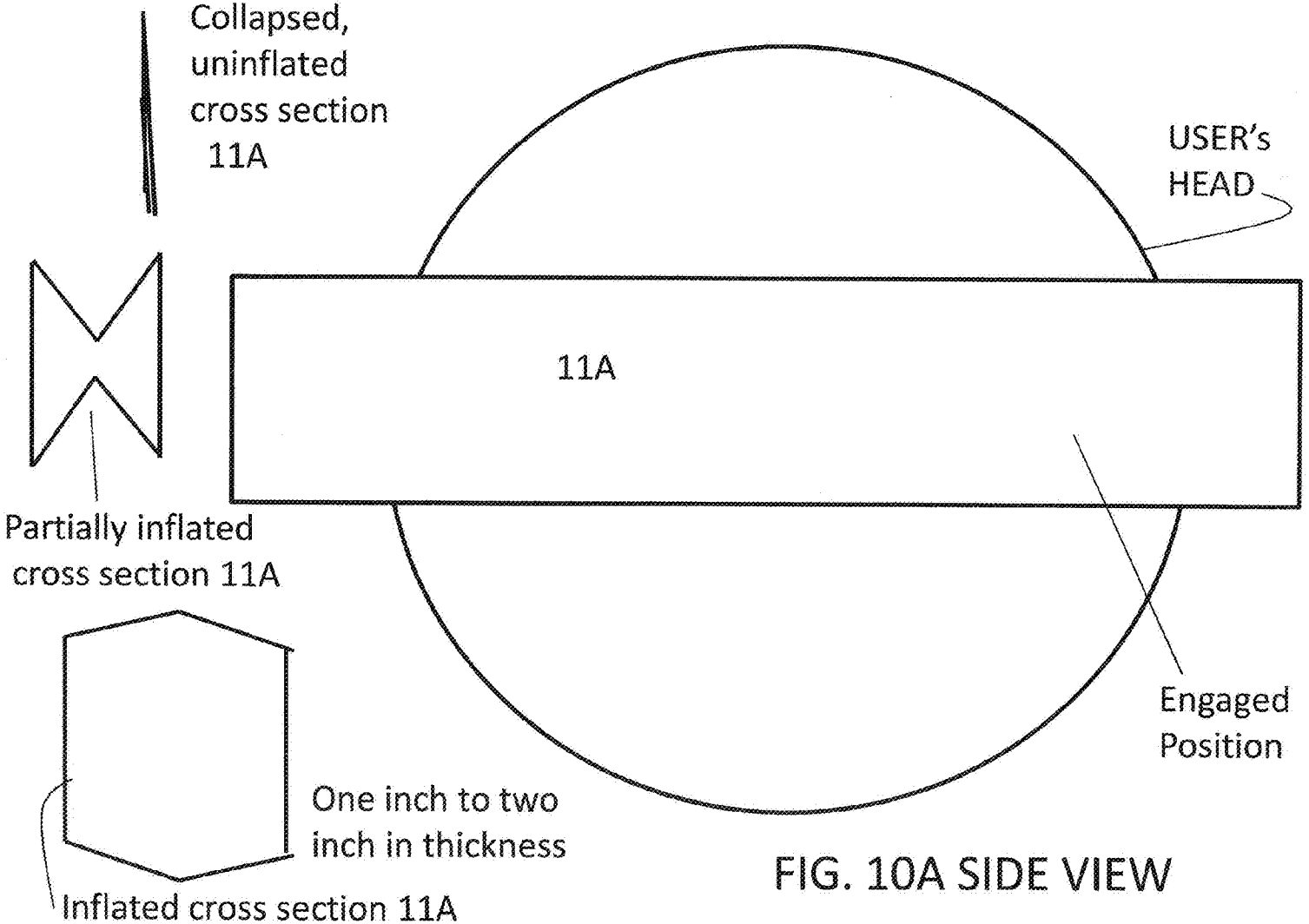
FIG. 10A SIDE VIEW

SIDE VIEW

WEARABLE PROTECTION DEVICE AND METHOD THEREOF

FIELD OF THE INVENTION

The present invention relates to head protectors and the like.

BACKGROUND OF THE INVENTION

Generally speaking, an airbag comprises three parts. The bag itself is made of a thin, nylon fabric, which is folded into the a vehicle part such as a steering wheel or dashboard. The sensor triggers the inflation of the bag, which happens upon a collision impact, such as running into a wall at 10 to 15 miles per hour. An inertia switch or a mechanical switch is tripped when there is a mass shift that closes an electrical contact, indicating that a crash has occurred. The sensors receive information from an accelerometer built into a microchip. A propellant is used to inflate the airbag. According to Wikipedia, the decision to deploy an airbag in a frontal crash is made within 15 to 30 milliseconds after the onset of the crash, and both the driver and passenger airbags are fully inflated within approximately 60-80 milliseconds after the first moment of vehicle contact. Naturally, if an airbag deploys too late or too slowly, the risk of occupant injury from contact with the inflating airbag may increase. The airbag sensor is a MEMS accelerometer, which is a small integrated circuit with integrated micro mechanical elements. The microscopic mechanical element moves in response to rapid deceleration, and this motion causes a change in capacitance, which is detected by the electronics on the chip that then sends a signal to fire the airbag. One common MEMS accelerometer in use is the ADXL-50 by Analog Devices, but there are other MEMS manufacturers as well.

According to Wikipedia, initial attempts using mercury switches did not work well. Before MEMS, the primary system used to deploy airbags was called a "rolamite". A rolamite is a mechanical device, consisting of a roller suspended within a tensioned band. As a result of the particular geometry and material properties used, the roller is free to translate with little friction or hysteresis. This device was developed at Sandia National Laboratories. The rolamite, and similar macro-mechanical devices were used in airbags until the mid-1990s when they were universally replaced with MEMS.

From the onset of the crash, the entire deployment and inflation process is about 0.04 seconds. Because vehicles change speed so quickly in a crash, airbags must inflate rapidly to reduce the risk of the occupant hitting the vehicle's interior.

According to Wikipedia, when the frontal airbags are to deploy, a signal is sent to the inflator unit within the airbag control unit. An igniter starts a rapid chemical reaction generating primarily nitrogen gas (N2) to fill the airbag making it deploy through the module cover. Some airbag technologies use compressed nitrogen or argon gas with a pyrotechnic operated valve ("hybrid gas generator"), while other technologies use various energetic propellants. Propellants containing the highly toxic sodium azide (NaN3) were common in early inflator designs. However, propellants containing sodium azide were widely phased out during the 1990s in pursuit of more efficient, less expensive and less toxic alternatives. The azide-containing pyrotechnic gas generators contain a substantial amount of the propellant. The driver-side airbag would contain a canister containing about 50 grams of sodium azide. The passenger side container holds about 200 grams of sodium azide. The alternative propellants may incorporate, for example, a combination of nitroguanidine, phase-stabilized ammonium nitrate (NH4NO3) or other nonmetallic oxidizer, and a nitrogen-rich fuel different than azide (e.g. tetrazoles, triazoles, and their salts). The burn rate modifiers in the mixture may be an alkaline metal nitrate (NO3-) or nitrite (NO2-), dicyanamide or its salts, sodium borohydride (NaBH4), etc. The coolants and slag formers may be e.g. clay, silica, alumina, glass, etc.[31] Other alternatives are e.g. nitrocellulose based propellants (which have high gas yield but bad storage stability, and their oxygen balance requires secondary oxidation of the reaction products to avoid buildup of carbon monoxide), or high-oxygen nitrogen-free organic compounds with inorganic oxidizers (e.g., di or tricarboxylic acids with chlorates (ClO3-) or perchlorates (HClO4) and eventually metallic oxides; the nitrogen-free formulation avoids formation of toxic nitrogen oxides). See Liquid propellant airbag inflator with dual telescoping pistons U.S. Pat. No. 6,039,347, hereby incorporated by reference.

While a concerted effort has been made to make and install air bags in automobiles, little has been done as far as wearable, expandable protection devices. Helmet technology generally focuses on the inside of the helmet, where little space is available, as opposed to outside of the helmet protection where space is not a factor.

Clothing is intended to function as a covering for the purposes of preserving body temperature, without providing shock absorption protection. In the case of circus performers, attention is given to ground covering, yet none is given to wearable protection. Airbag suits have also been developed for use by Motorcycle Grand Prix riders, as disclosed in Motorcycle News Dainese airbag suit in action 21 Nov. 2007. They are connected to the motorcycle by a cable and deploy when the cable becomes detached from its mounting clip, inflating to protect the back.

SUMMARY OF THE PRESENT INVENTION

A preferred embodiment comprises a an inflatable band which in a first mode resembles a sweat band, and to the audience or onlooker is perceived to be a conventional sweat band, or helmet band. The band may contain absorbent material and function as a moisture absorbing band. However, when activated, the band expands to form a cushion interface which provides a cushion between the wearer and the ground, hard surface or floor. The preferred embodiment band may be inflated by an inner chamber or chambers of highly compressed gas. Optionally, the inner chamber may be in the form of a tube. Upon actuation, the tube is opened to allow gas to enter the expandable band. The band may be activated by a proximity sensor, inertia switch or by a sound or a cord or switch actuated by the wearer. The actuation may be accomplished by an electrical charge which may be used to melt a frangible wire or melt the plastic surrounding the wire allowing the compressed gas to escape.

When positioned outside of the helmet, the compressed gas chamber may optionally be located within the helmet, with the expandable band surrounding the periphery or being placed in a strategic position on the helmet, such as the back of the helmet surface to alleviate the shock when the wearer falls backwards. Additionally, the expandable portion may prevent injuries to others struck by the helmet. For example, when a football player strikes another player using his helmet, the expandable band, when actuated, may prevent serious injury to the other player.

As used herein, the ground or opposing player may be the potential point of impact. A proximity detector may be used to detect the potential point of impact using an electromagnetic field and/or an inertia switch, where the combination of a velocity or acceleration is detected along with proximity to point of impact.

The expandable band may be a one-time use, disposable band, or may be reusable. When used in conjunction with a helmet, the expandable band may form a part of the helmet and expand and contract as the situation warrants. For example, in the case of a quarterback during a football game, the helmet may comprise an expandable portion which expands upon proximity to the ground or a hard surface being detected. A compressed gas chamber may be located within the helmet or on the wearer's body which provides compressed air in emergency situations. After actuation, a release mechanism may be used to release the compressed gas to the environment, with the helmet reverting to its original pre-deployment shape.

Optionally, one or more proximity sensors may be utilized on the periphery of the helmet so as to be individually actuated. Thus, if the back of the helmet is approaching the ground or another object, only the back of the helmet is expanded to provide a cushion to the wearer. This feature may be embodied by using separate expandable chambers along the periphery of the helmet. The expandable chambers may comprise synthetic rubber such as that used on conventional inner tubes.

In terms of the compressed air chamber, it is noted that air bags are deployed using compressed air cartridges. An air bag cartridge, the explanation of which is set forth in the background and is hereby incorporated by reference as though reprinted here, may be used to inflate the expandable bands 11, 11A, 12, 14, 15, and 22.

In order to prevent accidental actuation, the sensor may contain an inactive position, for use between performances (as in a circus) or plays of a football game or the like.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which: The drawings of this invention are illustrative and diagrammatic in nature in order to present the principles of the invention. They are being provided as examples without limiting the invention to the specific configuration or dimensions shown.

FIG. 1 is a schematic illustration of a top view of a preferred embodiment expandable band constructed using the principles of the present invention.

FIG. 2 is a diagrammatic illustration of a prior art proximity sensor.

FIG. 3 is a schematic illustration of another preferred embodiment of the present invention comprising a back view of an expandable band 11, top band 12, intermediate support 12 and neck support 15.

FIG. 4A is a schematic top view of the preferred embodiment of FIG. 1 upon inflation.

FIG. 4B is a schematic cross section of the band 11 of the FIG. 1 embodiment upon inflation.

FIG. 6A is a schematic top view of another preferred embodiment.

FIG. 10A is a schematic illustration of a preferred embodiment designed for use with a helmet such as a football helmet or for fitting over a users head, showing the inflated (engaged position). The orientation of the view is from the wearer's side.

FIG. 12 B is a schematic illustration depicting a cross sectional view of the inner tube 18 for containment of highly compressed gas.

FIG. 12 C is a schematic illustration depicting a top view of the fusible or frangible wire 19.

FIG. 12 D is a schematic illustration depicting a cross sectional view of the inner tube 18 for containment of highly compressed gas after the frangible wire is melted.

DETAILED DESCRIPTION OF PREFERRED EMBODIMENTS

Figure 5B:
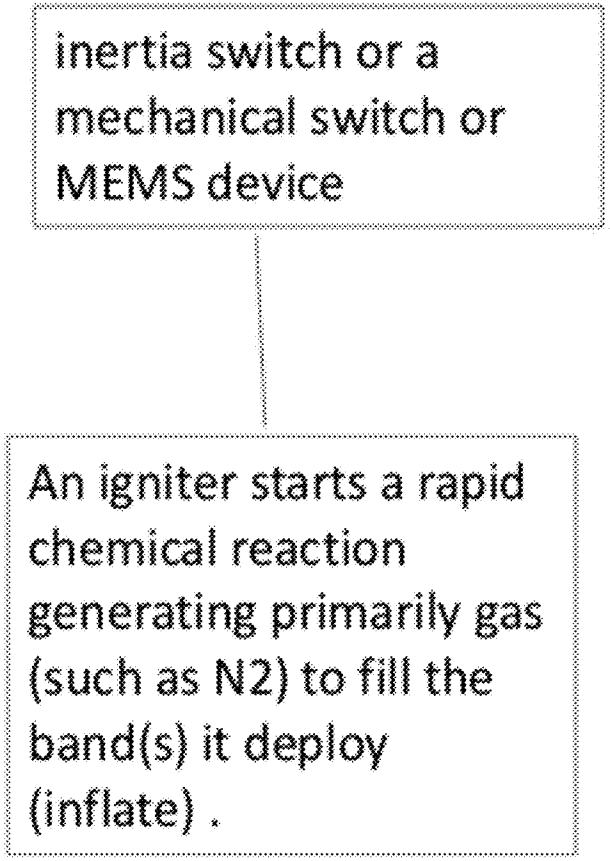
FIG. 5B is a block diagram of an alternative actuation/inflation subassembly for use with any of the embodiments herein.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout the description of the figures.

It will be understood that when an element is referred to as being "on" another element, it can be directly on the other element or intervening elements may be present. In contrast, when an element is referred to as being "directly on" another element, there are no intervening elements present. It will be understood that when an element is referred to as being "connected" or "coupled" to another element, it can be directly connected or coupled to the other element or intervening elements may be present. In contrast, when an element is referred to as being "directly connected or coupled" to another element, there are no intervening elements present. Furthermore, "connected" or "coupled" as used herein may include wirelessly connected or coupled. As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another. For example, a first layer could be termed a second layer, and, similarly, a second layer could be termed a first layer without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to other elements as illustrated in the Figures. It will be understood that relative terms are intended to encompass different orientations of the device in addition to the orientation depicted in the Figures. For example, if the device in one of the figures were turned over, elements described as being on the "lower" side of other elements would then be oriented on "upper" sides of the other elements. The exemplary term "lower", can therefore, encompass both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

A preferred embodiment comprises an expandable band 11, which may resemble in appearance a sweat band. Moreover, the band 11 may comprise absorbent material which functions to absorb moisture. Optionally the band 11 may include a cross band 12 which is positioned over the top of the wearer's head for additional protection. The bands 11, 12 may be inflated upon detection of an object or surface within the vicinity of the wearer. A proximity sensor (not shown) may be used to initiate inflation.

Proximity Sensor

As used herein, a proximity sensor is a sensor able to detect the presence of the ground or nearby objects without any physical contact. The proximity sensor may emit an electromagnetic or electrostatic field, or a beam of electromagnetic radiation (infrared, for instance), and sense any change in the field or return signal. A variety of proximity sensors may be used depending upon the particular application as a capacitive or photoelectric sensor may be suitable for situations in which there is, inter alia, a plastic target. An adjustable proximity sensor may be used when it is desirable to have adjustments of the nominal range or means to report a graduated detection distance. An example of a proximity sensor is the Sharp® GP2Y0D02 depicted schematically in FIG. 2. The GP2Y0D02 is an infrared proximity sensor with a detection field that extends 80 cm. The GP2Y0D02 requires a 5 volt power supply (not shown). A 0.1 uF bypass capacitor (C1) is used between power and ground The open collector output (pin 1) pulls to ground when no object is detected, a 12K pull-up resistor (R1) holds the signal high when an object is detected. When nothing is in front of the sensor, the detector holds the output low (0.40 volts). When an appropriate target is placed in front of the sensor, the output changes to high-impedance and the pull-up resistor (R1) holds the signal high (5 volts).

FIG. 3 is a schematic illustration of another preferred embodiment of the present invention comprising a back view of an expandable band 11, top band 12, intermediate support 12 and neck support 15. Optionally, a proximity sensor may be used to actuate the inflation mechanism comprising the compressed gas supply 17. The compressed gas supply may be mounted on the user or may be positioned on or within one of the bands 11, 12, 14 or 15. The neck support 15 may be inflatable from one to three inches to provide increased support for the neck of the wear to prevent, inter alia, a whip lash effect. The intermediate support may be a flexible connector, such as plastic, or may also inflate; or may contain the compressed air chamber 17.

FIG. 4A is a schematic top view of the preferred embodiment of FIG. 1 upon inflation.

FIG. 4B is a schematic cross section of the band 11 of the FIG. 1 embodiment upon inflation. Although a circular cross section is shown, the cross section may be of any shape, such as oval, square, rectangular, without departing from the scope of the invention.

FIG. 6A is a schematic top view of another preferred embodiment. The band 11 may be easily removed and may be inflated when mounted on a helmet, such as in the application for young children. Optionally, the band may be used without a helmet, such as for young children playing soccer. Optionally, the band 11 may be constructed using the material found in an inner tube, such as synthetic rubber, or may be of a solid, elastic construction. Optionally, a top support may be used with the embodiment of FIG. 5.

Figure 6B:
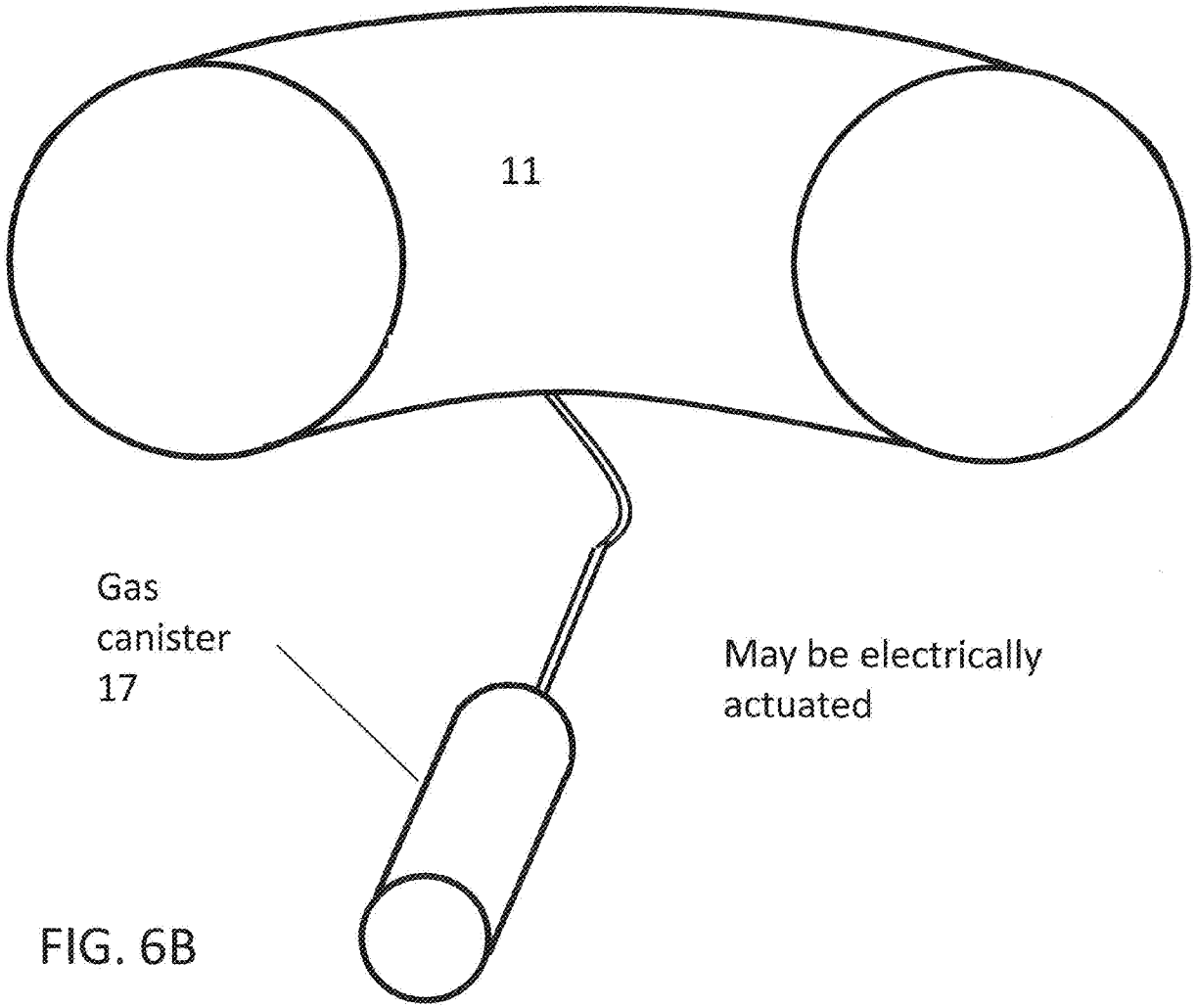
FIG. 6B diagrammatically illustrates the connection between the expandable band 11 and a compressed gas container or canister 17.

FIG. 6B diagrammatically illustrates the connection between the expandable band 11 and a compressed gas container or canister 17. The compressed gas chamber 15 may be of any shape, such as one to conform with the body of the wearer. Optionally, the compressed gas chamber 17, an air bag inflation device may be utilized or a device functioning in a manner similar to an air bag inflation apparatus may be used.

The band 11 may be made of a thin, nylon fabric, which is folded. A sensor triggers the inflation of the band 11, which happens upon a collision impact, such as running into a person or striking the ground. An inertia switch or a mechanical switch is tripped when there is a mass shift that closes an electrical contact, indicating that a "crash" or impact has occurred. The sensors receive information from an accelerometer built into a microchip. A propellant is used to inflate the band 11. The inflation may occur within 15 to 30 milliseconds after the onset of the crash. The sensor may be a MEMS accelerometer, which moves in response to rapid deceleration. Optionally, this motion may cause a change in capacitance, which is detected by the electronics on the chip that then sends a signal to fire the band inflation device. For example, one common MEMS accelerometer in use is the ADXL-50 by Analog Devices. The sensor may be mounted on the user or on the band or helmet.

Figure 5A:
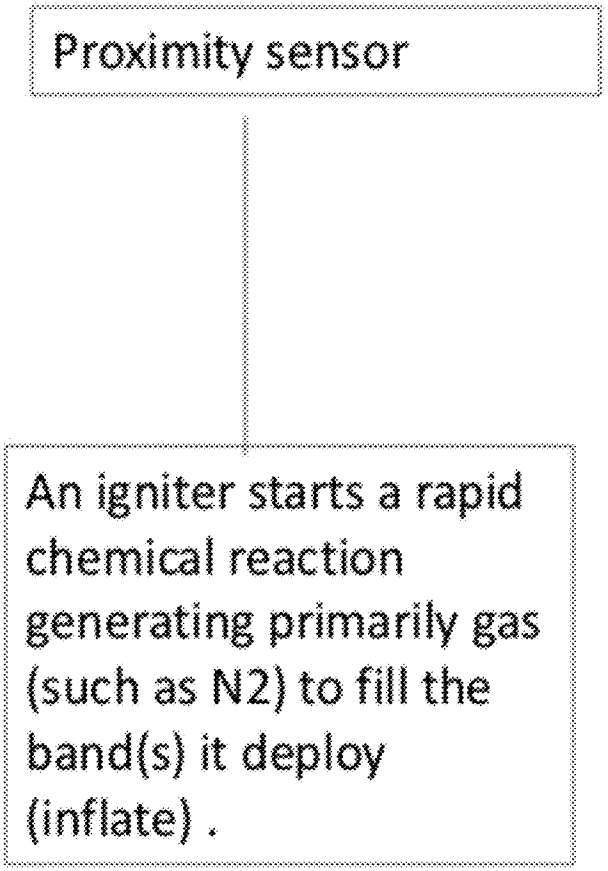
FIG. 5A is a block diagram of an actuation/inflation subassembly for use with any of the embodiments herein.
Figure 13:
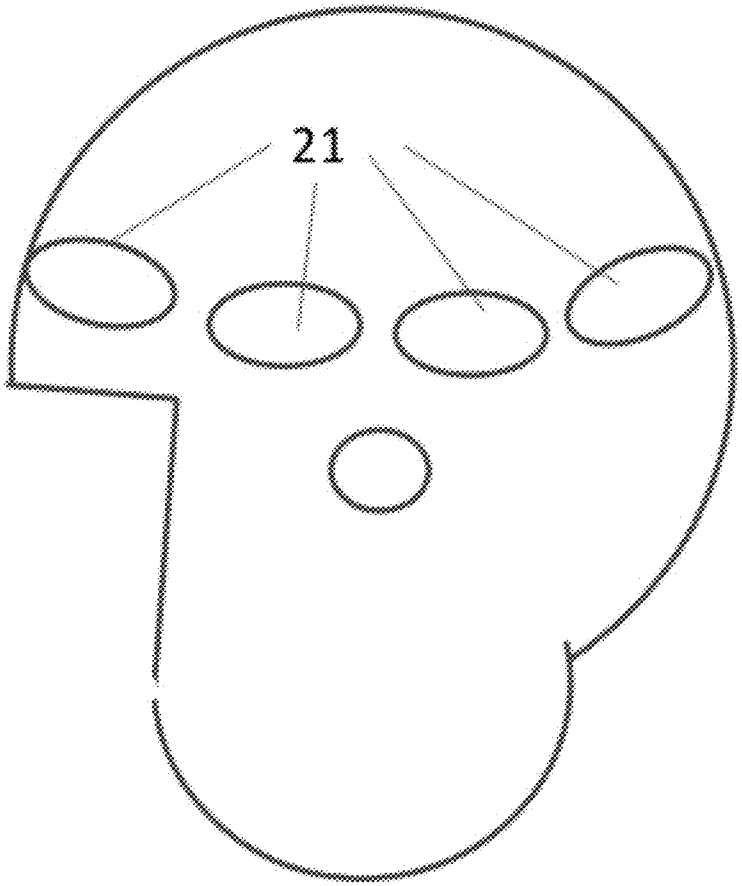
FIG. 13 is a schematic illustration of another preferred embodiment helmet assembly.
Figure 14:
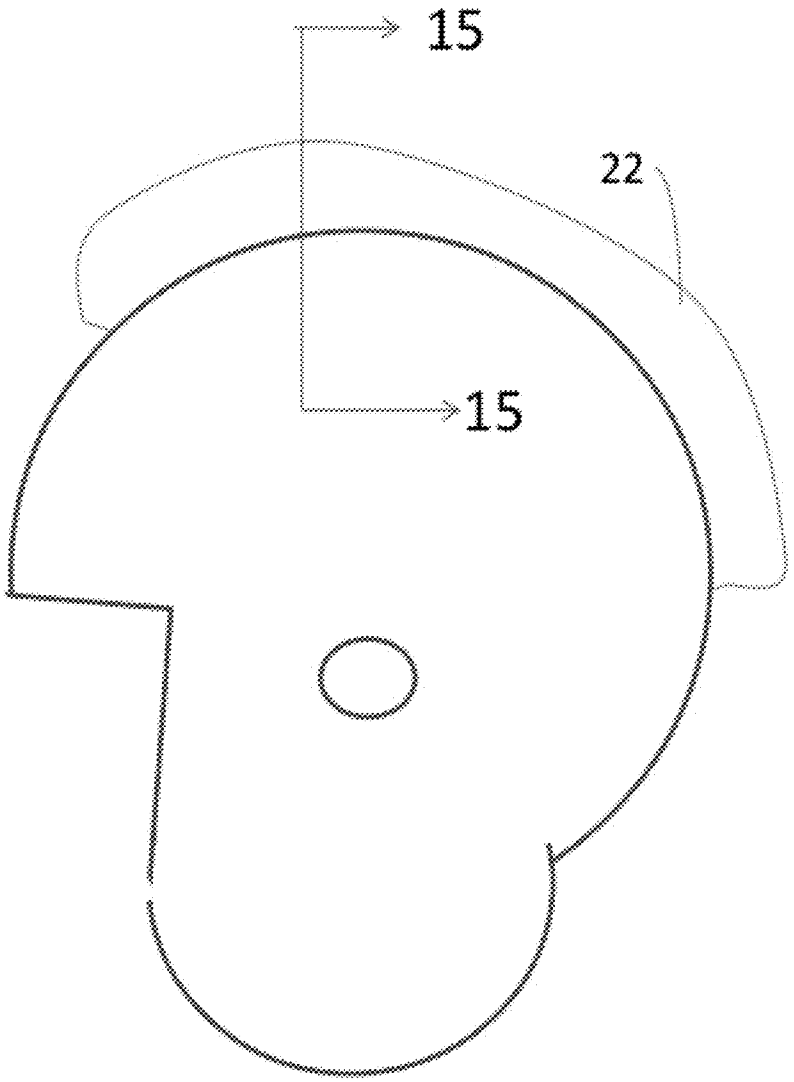
FIG. 14 is a schematic illustration of another preferred embodiment helmet assembly.
Figure 15:
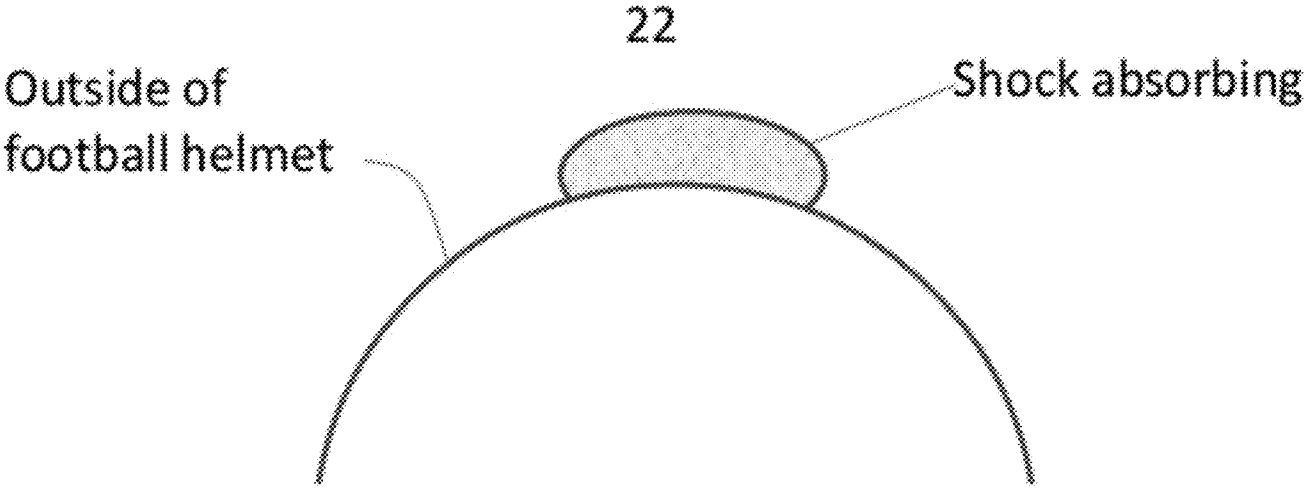
FIG. 15 is a schematic illustration of the preferred embodiment helmet assembly of FIG. 14 taken along lines 15.

FIG. 5A is a block diagram of an actuation/inflation subassembly for use with any of the embodiments herein comprising a proximity sensor which causes an igniter start to start a rapid chemical reaction generating primarily gas (such as N2) to fill the band(s) 11, 12, 14, and/or 15, or, alternatively, elements 21 in FIG. 13 or band 22 in FIGS. 14, 15.

FIG. 5B is a block diagram of an alternative actuation/inflation subassembly for use with any of the embodiments herein comprising an inertia switch which may be for example a MEMS device similar to that used when deploying air bags which causes an igniter start to start a rapid chemical reaction generating primarily gas (such as N2) to fill (inflate) the band(s)

Figure 5D:
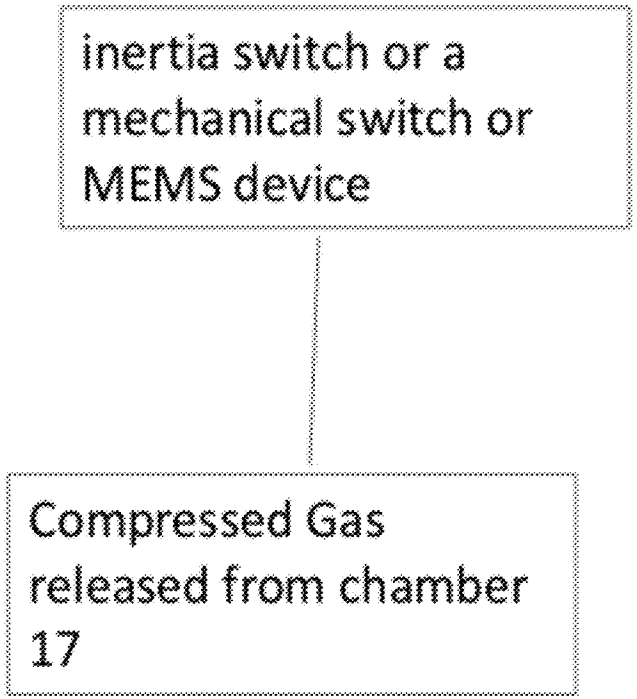
FIG. 5D is a block diagram of an alternative actuation/inflation subassembly for use with any of the embodiments herein.
Figure 5C:
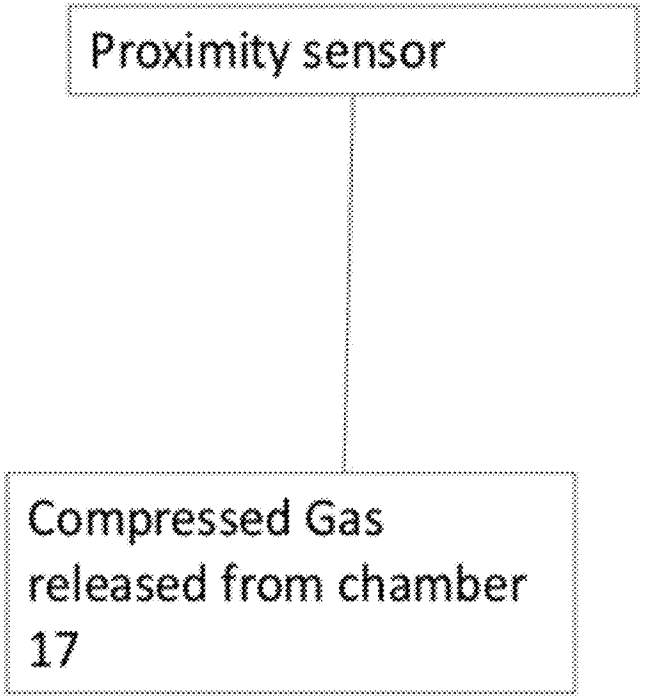
FIG. 5C is a block diagram of an alternative actuation/inflation subassembly for use with any of the embodiments herein.

FIG. 5C is a block diagram of an actuation/inflation subassembly for use with any of the embodiments herein comprising a proximity sensor which causes compressed gas form a chamber to be released to fill the band(s) 11, 12, 14, and/or 15, or, alternatively, elements 21 in FIG. 13 or band 22 in FIGS. 14, 15.

FIG. 5D is a block diagram of an actuation/inflation subassembly for use with any of the embodiments herein comprising an inertia switch which may be for example a MEMS device similar to that used when deploying air bags which causes compressed gas form a chamber to be released to fill the band(s) 11, 12, 14, and/or 15, or, alternatively, elements 21 in FIG. 13 or band 22 in FIGS. 14, 15.

Moreover, both a proximity sensor and an inertia type switch may be used for either the released of compressed air or causes an igniter start to start a rapid chemical reaction generating primarily gas (such as N2) to fill (inflate) the band(s)

Figure 17:
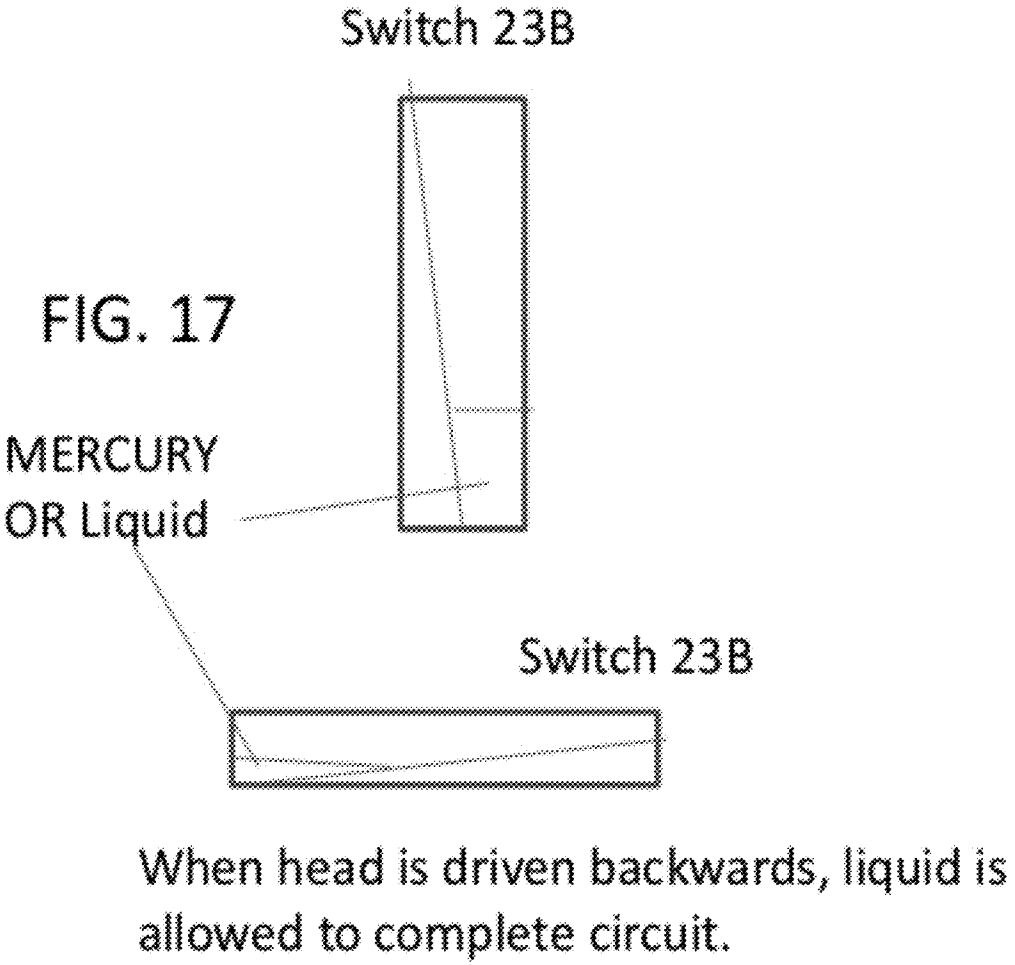
FIG. 17 is a schematic view of another switch assembly.

Optionally, a mercury switch may be used as depicted in FIG. 17. For example, when the head of the wearer or the helmet or band is tilted backwards to a horizontal position, such as when a foot ball player falls backwards onto the ground, the mercury in the switch completes the circuit causing deployment of the air into the bands 11, 12, 14, and/or 15, or, alternatively, elements 21 in FIG. 13 or band 22 in FIGS. 14, 15.

Figure 7:
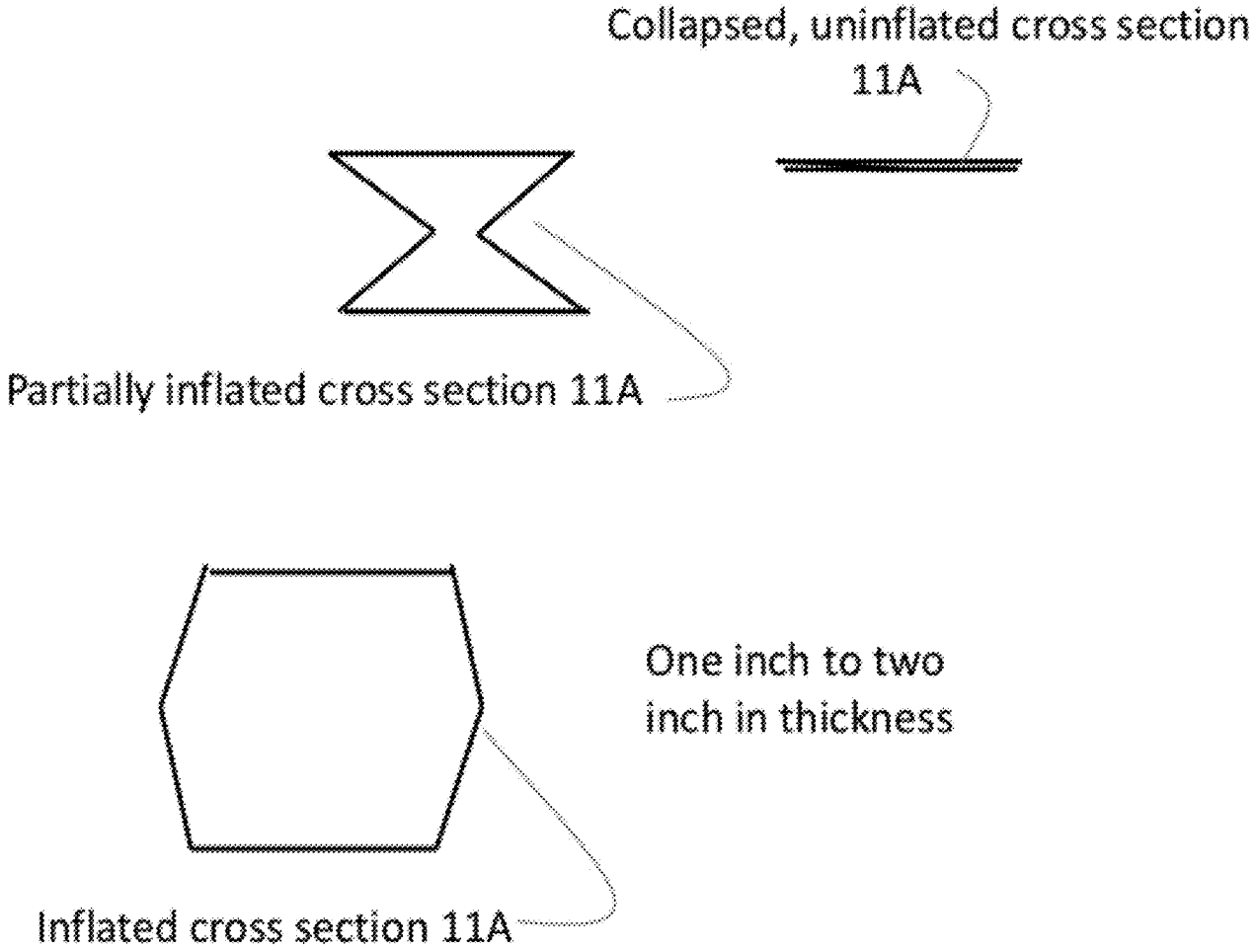
FIG. 7 is a schematic illustration of the expansion of the band 11A.

Optionally, one or more proximity sensors may be utilized on the periphery of the helmet so as to be individually actuated. Thus, if the back of the helmet is approaching the ground or another object, only the back of the helmet is expanded to provide a cushion to the wearer. This feature may be embodied by using separate expandable chambers along the periphery of the helmet. The expandable chambers may comprise synthetic rubber such as that used on conventional inner tubes FIG. 7 is a schematic illustration of the expansion of the band 11A. The cross section shown is merely exemplary as a variety of configurations may be used without departing from the scope of the present invention. Moreover, although the thickness of one to two inches is preferred, bands as thin as one-half inch and over two inches could be utilized.

Figure 8:
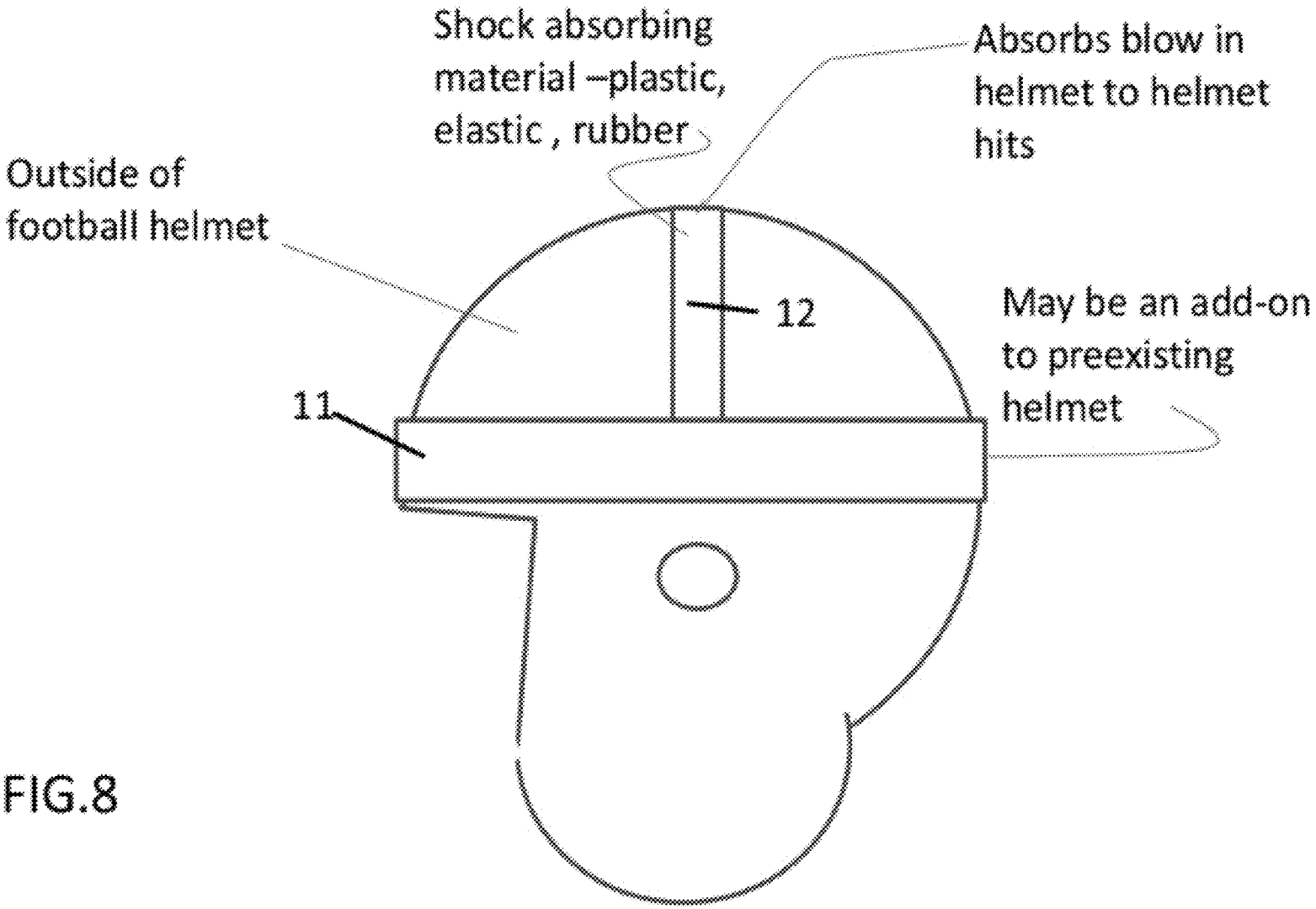
FIG. 8 is a schematic illustration of a preferred embodiment designed for use with a helmet such as a football helmet.

FIG. 8 is a schematic illustration of a preferred embodiment designed for use with a helmet such as a football helmet. The bands may be permanent attached or may be attachable and removable for replacement. The helmet may have associated with it an inertia sensor or proximity sensor as described in the foregoing. The bands 11 and/or 12 may be inflated using a compressed gas chamber or an inertia switch or a mechanical switch may be tripped when there is a mass shift that closes an electrical contact, indicating that an impact with the ground or another player crash has occurred. The sensors receive information from an accelerometer built into a microchip. A propellant is used to inflate the airbag. The sensor may comprise a MEMS accelerometer, which is a small integrated circuit with integrated micro mechanical elements. The microscopic mechanical element moves in response to rapid deceleration, and this motion causes a change in capacitance, which is detected by the electronics on the chip that then sends a signal to fire the airbag. One common MEMS accelerometer in use is the ADXL-50 by Analog Devices, but there are other MEMS manufacturers as well. For example, when a quarterback is hit hard by an opposing lineman, the initial impact will actuate the MEMS device to inflate the bands on the quarterback's helmet. When the quarterback strikes the ground, the bands will have inflated to ease the impact between the quarterbacks head and the ground.

Figure 9:
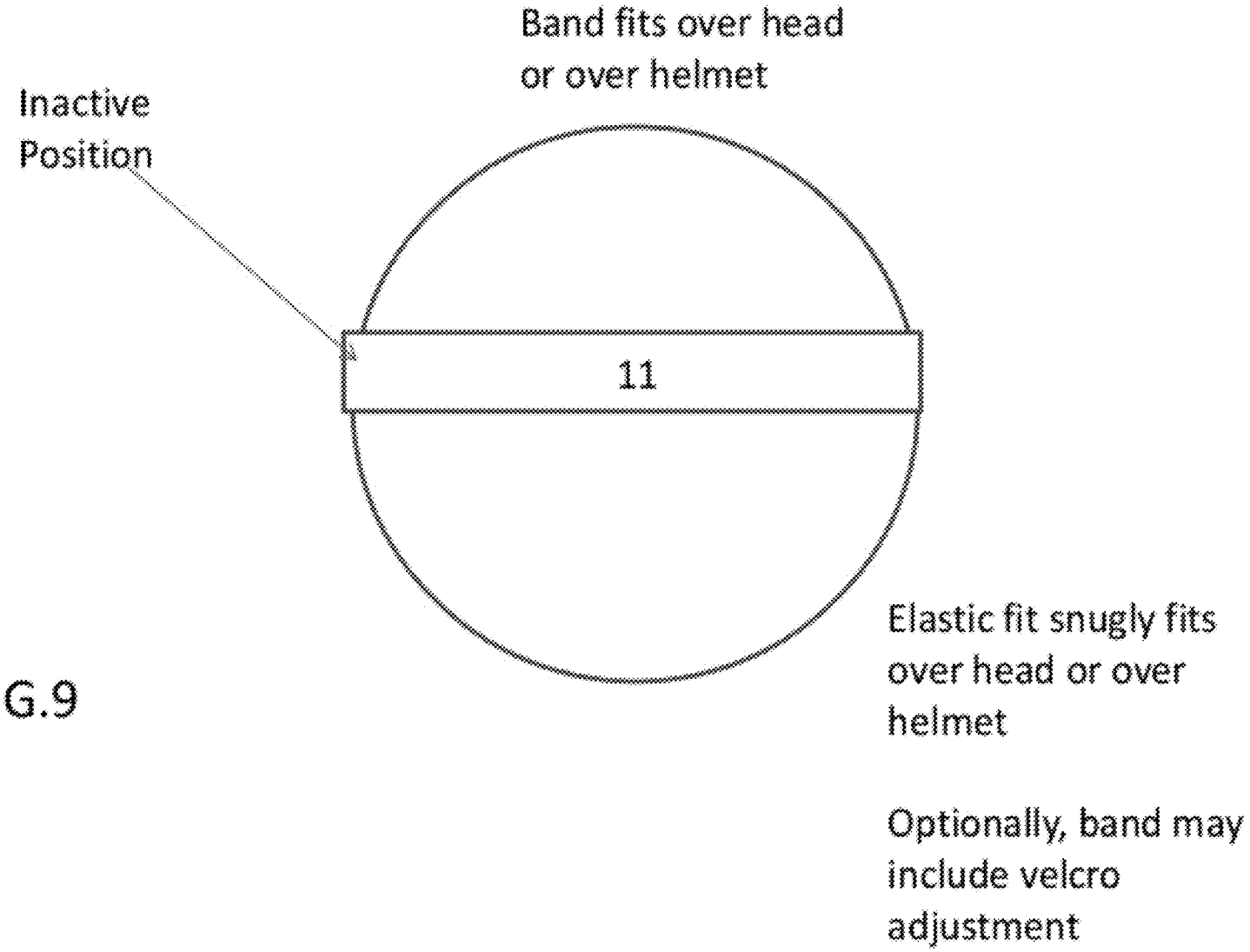
FIG. 9 is a schematic illustration of a preferred embodiment designed for use with a helmet such as a football helmet or for fitting over a users head optionally having a Velcro® attachment.

FIG. 9 is a schematic illustration of a preferred embodiment designed for use with a helmet such as a football helmet or for fitting over a users head optionally having a Velcro® attachment.

Figure 10B:
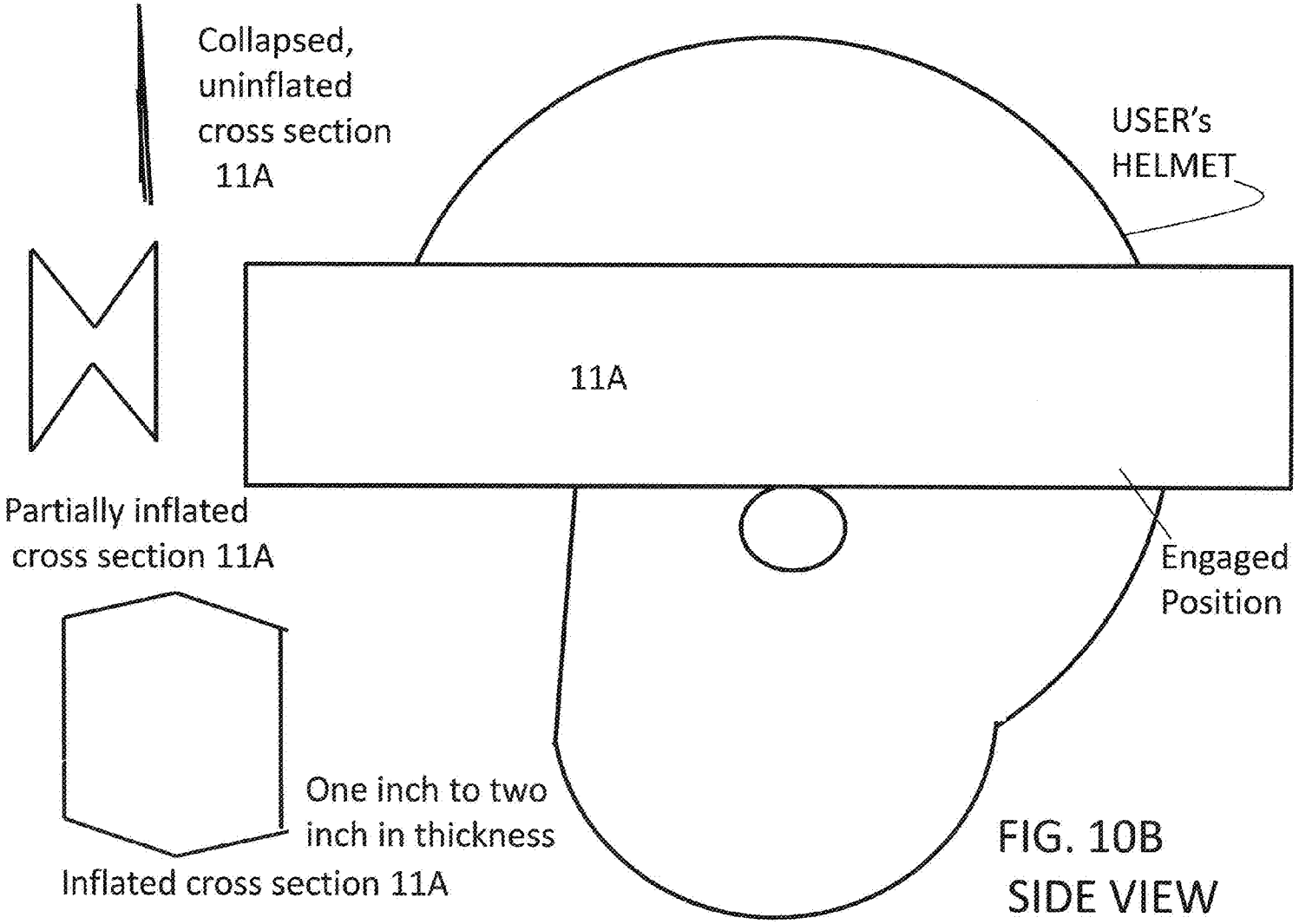
FIG. 10B is a schematic illustration of a preferred embodiment designed for use with a helmet such as a football helmet, showing the inflated (engaged position). The orientation of the view is from the wearer's side.

FIG. 10 is a schematic illustration of a preferred embodiment designed for use with a helmet such as a football helmet or for fitting over a users head, showing the inflated (engaged position).

Figure 11B:
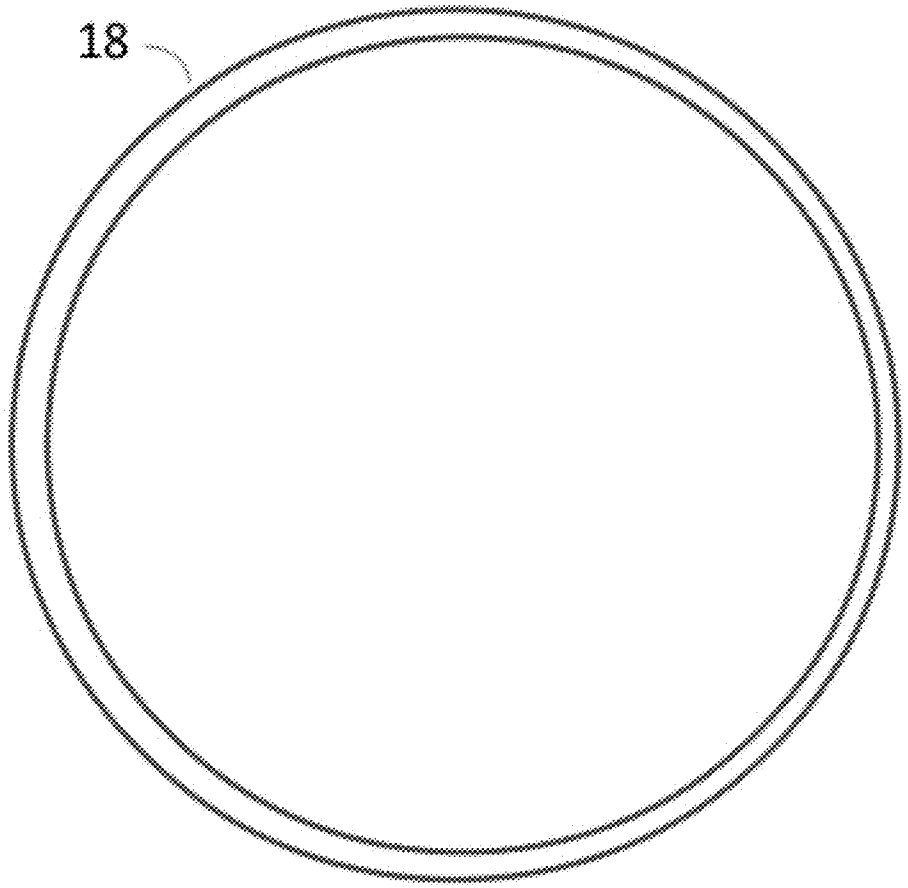
FIG. 11B is a schematic illustration of an inner tube portion 18 containing compressed gas.
Figure 11A:
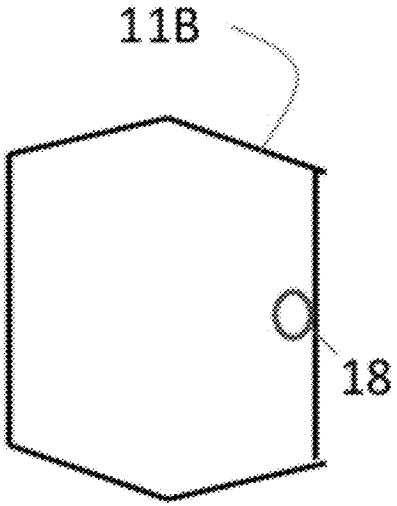
FIG. 11A is a schematic illustration of an inflated band 11B showing a cross sectional view.
Figure 12A:
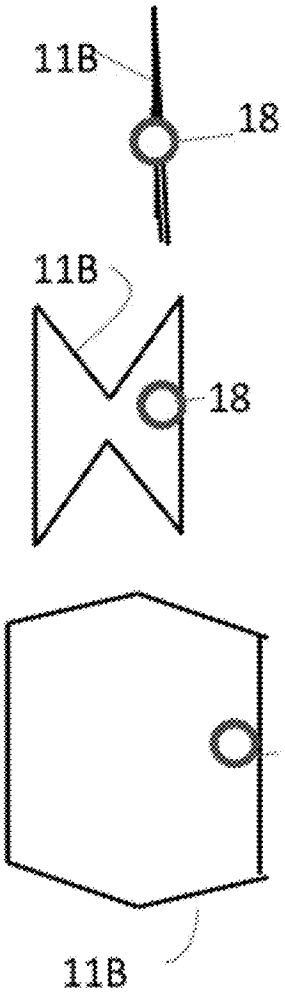
FIG. 12 A is a schematic illustration inflated band 11B showing a cross sectional view in three different stages.
Figure 12B:
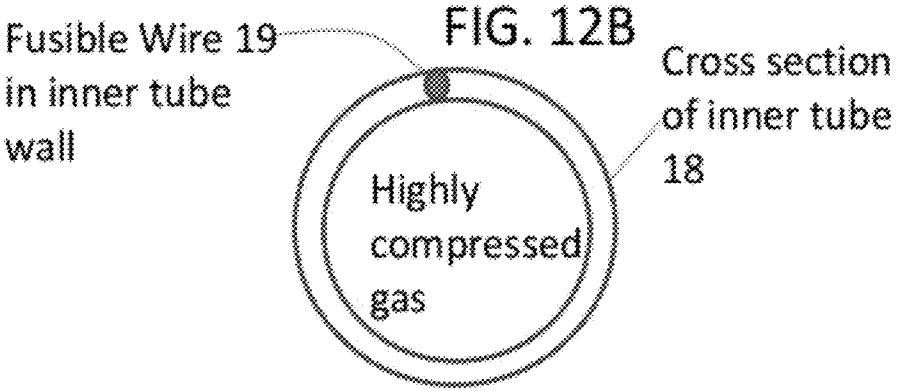
Figure 12C:
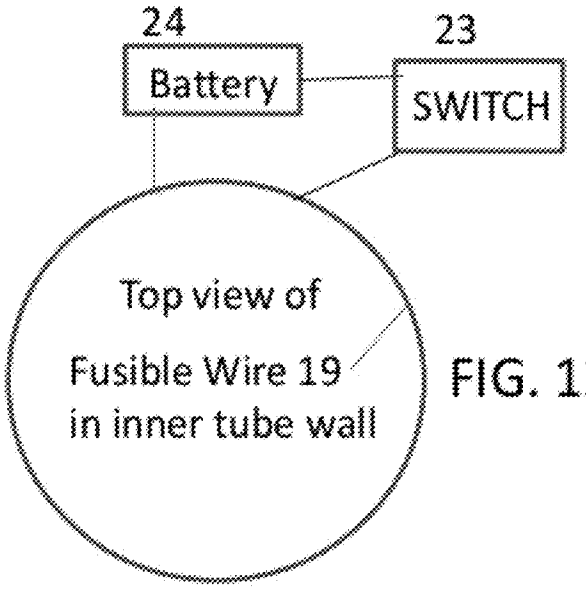
Figure 12D:
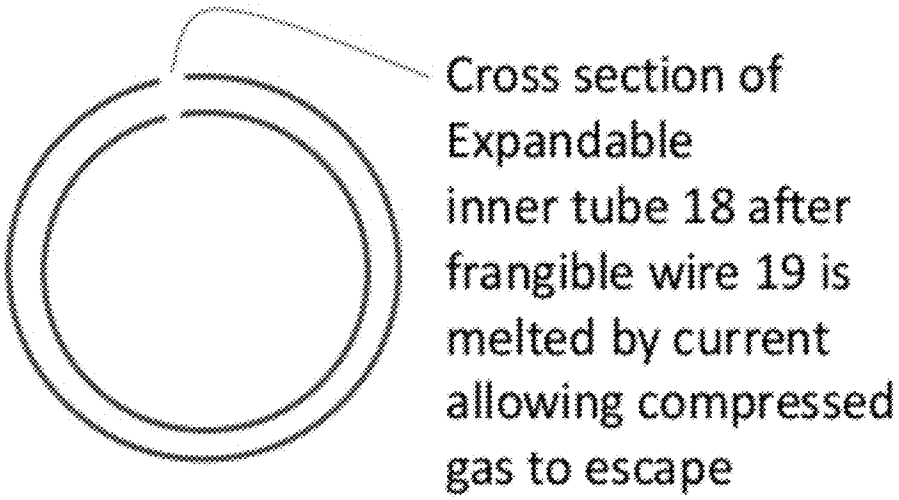

FIG. 11A is a schematic illustration of an inflated band 11B showing a cross sectional view comprising a inner tube 18 of compressed gas.

FIG. 11B is a schematic illustration of an inner tube portion 18 containing compressed gas, which may extend along the inner or outer periphery of the expandable band 11B.

FIG. 12 A is a schematic illustration inflated band 11B showing a cross sectional view in three different stages. In the uninflated stage, the band may be formed of clear plastic so that it is not readily visible. In the case of a circus performer, the band may be constructed so as to not be visible to the audience or may be disguised so as to appear as a sweat band. Optionally, the band may have absorbent properties so as to function as a sweat band.

FIG. 12 B is a schematic illustration depicting a cross sectional view of the inner tube 18 for containment of highly compressed gas.

FIG. 12 C is a schematic illustration depicting a top view of the fusible or frangible wire 19, which may extended within an electrical circuit whereby upon closure of the switch 23, which may optionally be a proximity device or inertia sensor, the frangible wire is heated and causes the inner tube 18 to split enabling gas to inflate the bands 11 and/or 12, 14, 15, and alternatively 21 or 22.

FIG. 12 D is a schematic illustration depicting a cross sectional view of the inner tube 18 for containment of highly compressed gas after the frangible wire is melted.

FIG. 13 is a schematic illustration of another preferred embodiment helmet assembly having segmented portions 21 which are inflated either separately or simultaneously. The segmented portions may form a permanent part of the helmet structure which are inflated by a proximity sensor or inertia switch as described above. Moreover, a plurality of proximity sensors could be used so that the proximity sensors are correlated to the portion of the helmet which will be impacted so that element(s) 21 correlating to the point of impact will solely be activated.

FIG. 14 is a schematic illustration of another preferred embodiment helmet assembly in which the inflatable area extends from the top to the back of the helmet. Optionally, in the uninflated position, only a slim band or nothing may appear from a side view of the helmet.

Upon actuation, as described above, the portion 22 is inflated (preferably approximately one half to 4 inches and most preferably approximately one to two inches). However, other thicknesses may be used without departing from the scope of the present invention.

FIG. 15 is a schematic illustration of the preferred embodiment helmet assembly of FIG. 14 taken along lines 15. The protector 22 may be approximately one inch to two inch in thickness. Protector 22 may be an add-on to preexisting helmet. Protector 22 may be used to absorb blow in helmet to helmet hits. Protector 22 may comprise shock absorbing material, such as plastic, elastic material or rubber.

Figure 16:
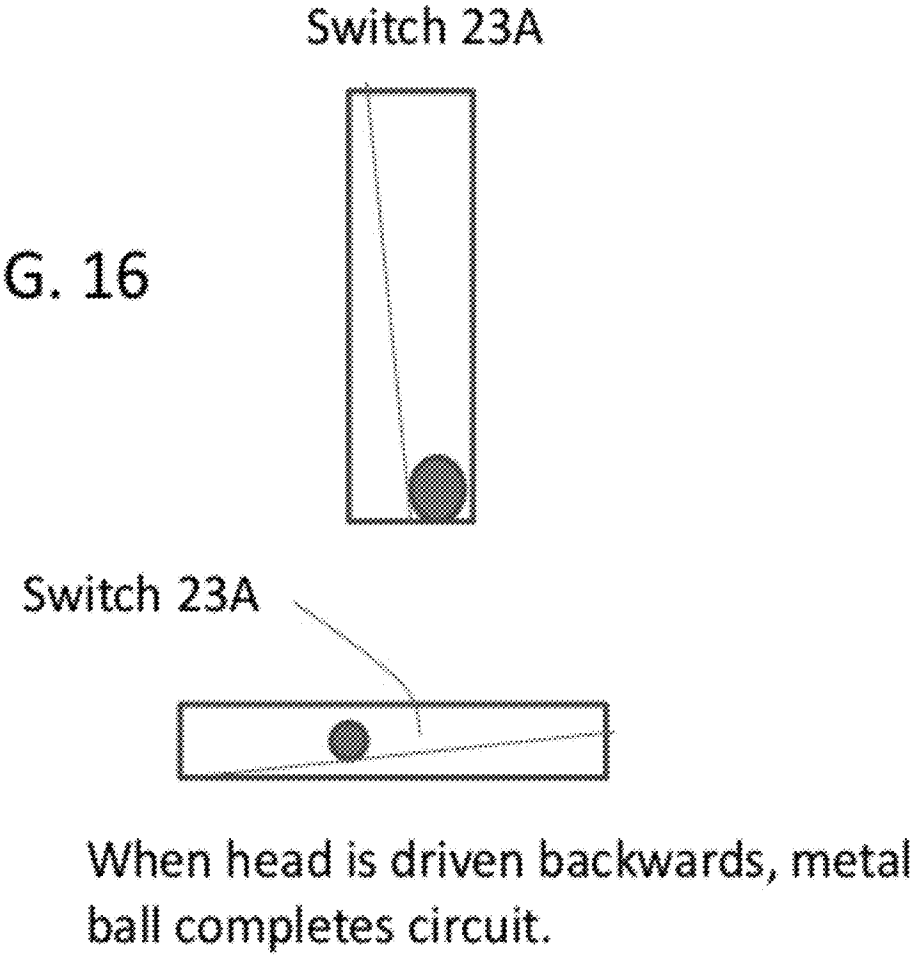
FIG. 16 is a schematic view of a switch assembly.

FIG. 16 is a schematic view of an alternate switch assembly which may be substituted for the inertia switch or proximity sensor described above. The switch 23A, shown in FIG. 16, may be located in periphery of the band. Switch 23 may be activated by an inertia-type switch—where substantial impact closes circuitry. Alternatively, switch 23 may be activated by the head of the user being tilted backwards suddenly (as in falling backwards) by inertia type switch—where substantial impact closes circuitry. As partially depicted in FIG. 16, when the head of the user is driven backwards, the metal ball completes the circuit to destroy frangible wire and cause compressed gas to inflate expandable band.

FIG. 17 is a schematic view of another switch assembly of an alternate switch assembly which may be substituted for the inertia switch or proximity sensor described above. Switch 23B may be located in periphery of band. Switch 23B may be activated by inertia type switch—where substantial impact closes circuitry. Alternatively Switch 23B may be activated by head being tilted backwards suddenly [as in falling backwards by inertia type switch—where substantial impact closes circuitry. When head is driven backwards, liquid is allowed to complete circuit to destroy frangible wire and cause compressed gas to inflate expandable band.

Figure 18:
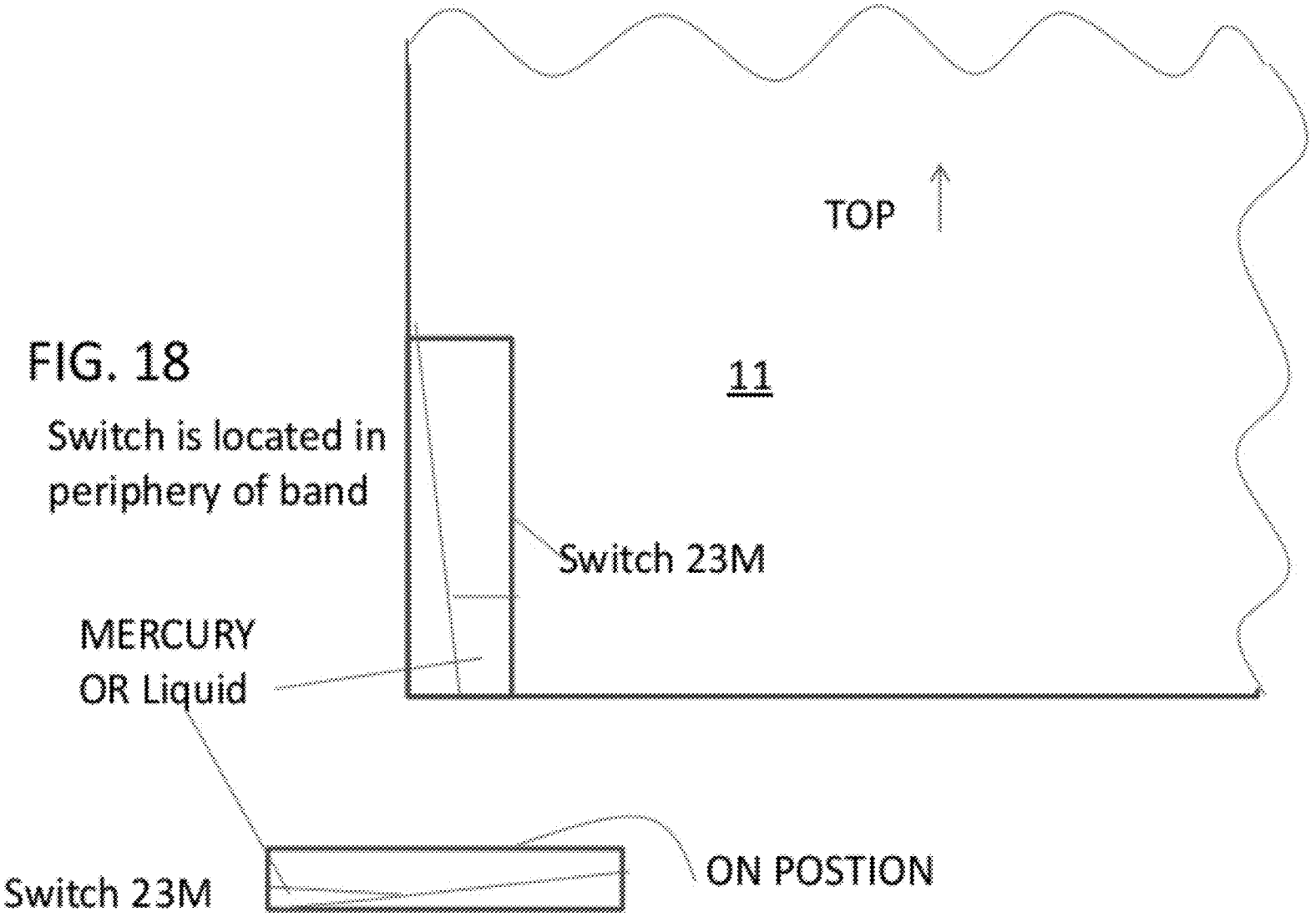
FIG. 18 is a schematic view of the switch assembly of FIG. 17 mounted in a band 11.

FIG. 18 is a schematic view of the switch assembly of FIG. 17 mounted in a band 11. The switch may comprise a mercury switch mounted to a helmet such that when the head of a quarterback is upright, the mercury will not actuate the switch. However, as the quarterback falls backwards towards the ground, the mercury cause the switch to close thereby enabling an electrical circuit which may cause compressed gas to escape or ignite a propellant similar to that used in conjunction with airbag deployment.

As used the following claims, the terminology impact includes impact with an opponent, a hard surface or the ground.

Although a few exemplary embodiments of the present invention have been shown and described, it would be appreciated by those skilled in the art that changes may be made in these embodiments, without departing from the principles and spirit of the invention, the scope of which is defined in the claims and their equivalents.

The invention claimed is:

1. A device adapted to be worn on the head of a user comprising:

at least one inflatable band adapted to encircle the middle of the head of the user and having first and second modes; the at least one inflatable band adapted to encircle the middle of the head of the user in both the first and second modes, the at least one inflatable band being deflated in a first mode and inflated in a second mode; one of a proximity sensor, inertia switch or gravity actuated switch operatively connected to the at least one inflatable band; a gas releasing device operatively connected to the at least one inflatable band which causes the inflatable band to be inflated with gas when one of the proximity sensor, inertia switch or gravity switch is actuated;

whereby the device is adapted to encircle and protect the middle of the head of the user and is automatically activated in the case of a fall or impact to cushion the head of the user.

2. The device of claim 1 wherein at least one inflatable band comprises a first portion which is configured to encircle the front and back of the user's head and a second portion which crosses over the top of the user's head, the first and second portions being interconnected so as to inflate simultaneously, and wherein the proximity sensor is attached to the at least one inflatable band which actuates the inflation of the first and second portions.

3. The device of claim 1 wherein the band is configured to extend along the circumference of the middle of the head of the user and to be self supporting around the circumference of the head of the user in both the first and second modes and to be in contact with the head of the user and wherein the gas releasing, device is operatively connected to the at least one inflatable band through at least one tube and wherein the gas releasing device is adapted to be attached to the user's body.

4. The device of claim 1 wherein the gas releasing device is actuated by the proximity sensor that detects the proximity of the user to the ground of a hard surface and wherein the gas releasing device is connected to the at least one inflatable band by tubing, and wherein the gas releasing device is adapted to be attached to the body of the user.

5. The device of claim 1 further comprising an electrical circuit comprising a battery, wherein one of the proximity sensor, inertia switch, or gravity actuated switch closes the electrical circuit which actuates the discharge of a gas which inflates the inflatable band, the inflatable and adapted to protect the skull of the user without the need of a helmet.

6. The device of claim 1 comprising the inertia switch which upon impact greater than a predetermined amount causes a chemical reaction in which compressed gas is generated to fill the inflatable band, the inflatable band adapted to be in close contact with and protect the head of the user.

7. The device of claim 1 comprising the proximity sensor which upon the sensing of an object within a predetermined range causes a chemical reaction in which compressed gas is generated to fill the inflatable band.

8. The device of claim 1 wherein the at least one inflatable band is formed of clear plastic so that the user's head is visible through the inflatable band and so that the inflatable band is substantially concealed on the head of the user.

9. The device of claim 1 wherein the inner and outer surfaces of the at least one inflatable band are substantially circular in both the first and second modes and resemble in appearance a sweatband in the first mode, and the at least one inflatable band is self supporting around the circumference of the head of the user in both the first and second modes.

10. The device of claim 1 comprising both an inertia switch and a proximity sensor for usage together which cause actuation wherein compressed gas is released from a compressed gas chamber to fill the inflatable band.

11. The device of claim 1 comprising both an inertia switch and a proximity sensor which cause actuation whereby a chemical reaction is produced in which gas is generated to fill the inflatable band.

12. The device of claim 9 wherein the compressed gas chamber comprises a tube within the at least one inflatable, band, the tube comprising a frangible wire which when melted by electricity causes the tube to release the compressed gas and inflate the at least one inflatable band.

13. A device adapted to be worn on the head of a user comprising:

an inflatable band having first and second states; a first state in which the inflatable band is collapsed and adapted to closely encircle the middle of the head of the user having the appearance and configuration of a sweat band, and a second state in which the cross section of the inflatable band is inflated;

a sensor operatively connected to the inflatable band;

a gas releasing device which causes the inflatable band to inflate when the sensor is actuated;

whereby the inflatable hand is worn on the head of the user and is automatically activated from the first state to the second state in the case of a fall or sudden impact to cushion the head of the user.

14. The device of claim 13 wherein the inflatable band resembles a sweat band in appearance and comprises absorbent material, and wherein the inflatable band is self supporting around circumference of the head of the user in both the first and second states and wherein the sensor is one of a proximity sensor, inertia switch, or gravity actuated switch.

15. The device of claim 14 wherein in the first and second states the inner surface of the inflatable band is in contact with and is configured to encircle the middle of the head of the wearer and in the second state the thickness of the cross section of the inflatable band is in the range of one to two inches.

16. The device of claim 14 further comprising a cross band directly connected to the inflatable band which is adapted to be positioned over the top of the head of the wearer and inflate simultaneously with the inflation of the inflatable band.

17. The device of claim 13 wherein the sensor is a proximity sensor attached to the inflatable band, and the proximity sensor is adjustable for graduated distance detection that extends to at least 80 cm. and wherein the inflatable band contains absorbent material that functions as a moisture absorbing band, and wherein the sensor is configured to activate a compressed gas cartridge on the wearer's body.

18. The device of claim 13 wherein the material forming the inflatable band comprises an elastic material and wherein the sensor is a MEMS device which causes an igniter operatively connected to the as releasing device to start a rapid chemical reaction generating a gas to inflate the inflatable band.

19. The device of claim 14 wherein the inflatable band comprises first and second portions which are adapted to tightly encircle the head of the user in the first state, the first and second portions being interconnected by intermediate portions which form an accordion fold in the first state, and where when the inflatable band inflates in the second state in a direction outward from the head of the user, the first and second portions become spaced apart with the intermediate portions unfolding and extending therebetween.

20. The device of claim 19 wherein the intermediate portions form parallel folds between the first and second portions in the first state and wherein the inflatable band comprises a release which allows deflation to enable reuse of the inflatable band.

* * * * *